US007828606B2

(12) United States Patent
Singer

(10) Patent No.: US 7,828,606 B2
(45) Date of Patent: Nov. 9, 2010

(54) PUSH LOCK CONNECTOR

(75) Inventor: Helmut Singer, Bad Ditzenbach (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 177 days.

(21) Appl. No.: 12/221,849

(22) Filed: Aug. 7, 2008

(65) Prior Publication Data

US 2009/0047822 A1 Feb. 19, 2009

(30) Foreign Application Priority Data

Aug. 10, 2007 (DE) ..... 10 2007 039 307

(51) Int. Cl.
*H01R 13/514* (2006.01)

(52) U.S. Cl. ..... 439/752; 439/595

(58) Field of Classification Search ..... 439/752, 439/595, 347

See application file for complete search history.

(56) References Cited

U.S. PATENT DOCUMENTS

| | | | | |
|---|---|---|---|---|
| 5,830,013 | A | 11/1998 | Saito et al. | |
| 7,559,789 | B2 * | 7/2009 | Hashim | 439/405 |
| 2001/0039151 | A1 * | 11/2001 | Tsuji et al. | 439/752 |
| 2002/0013105 | A1 * | 1/2002 | Kashiyama | 439/752 |
| 2004/0253884 | A1 * | 12/2004 | Sakurai et al. | 439/752 |
| 2005/0255756 | A1 * | 11/2005 | Tanaka et al. | 439/752 |
| 2007/0128953 | A1 * | 6/2007 | Ciriello et al. | 439/752 |

FOREIGN PATENT DOCUMENTS

| | | | |
|---|---|---|---|
| DE | 34 41 559 | A1 | 5/1986 |
| DE | 38 28 872 | A1 | 3/1989 |
| DE | 41 14 931 | A1 | 11/1991 |
| DE | 42 05 974 | C1 | 6/1993 |
| DE | 695 01 088 | T2 | 3/1998 |
| EP | 0 511 649 | A2 | 4/1992 |
| EP | 0 673 084 | A1 | 3/1995 |

* cited by examiner

*Primary Examiner*—Hien Vu
(74) *Attorney, Agent, or Firm*—Peter Van Winkle

(57) ABSTRACT

A plug connector (11, 12), having a body (13, 16) with boreholes containing contacts (14, 15), and a detent (23-26) that protrudes into the boreholes (21, 22) behind a contact collar (65). To make possible the locking insertion of not only thicker and therefore relatively stiff cables but also of such thin cables, for example those that are braided, which due to their relatively small cross section easily buckle when stressed in the sliding longitudinal direction, it is provided that the detent (23-26) can be inserted into the borehole (21, 22) in two successive positions, whereby in the first, preliminary locking position, the deflection resistance of the detent (23, 26) is smaller than it is when bringing the plug contact (14, 13) into the second, and final locking position.

4 Claims, 4 Drawing Sheets

PUSH LOCK CONNECTOR

CROSS-REFERENCE TO RELATED APPLICATION

Applicant claims priority from German patent application no. 10 2007 039 307.7 filed Aug. 10, 2007.

BACKGROUND OF THE INVENTION

The present invention relates to a plug connector in accordance with the preamble of claim 1.

In a plug connector that is known from DE 42 06 974 C1, the detent has a clip arm, whose deflection resistance opposes the male or female plug contact being inserted into the housing via a crimped cable and being locked there. This force employed for a locking insertion of a male or female plug contact may only be applied if the cable connected with this contact is relatively stiff, so that when it is inserted it does not buckle. However, a cable having a thinner cross-section will buckle, especially if it is in the form of braids, so that a tool must be used to achieve a locking insertion of this kind of contact.

In another known plug connector, the contacts are inserted loose and then are locked in place. The disadvantage in—this lies in the fact that it is difficult to keep these contacts, which have been inserted into a plug connector loose, in place long enough to carry out the locking process.

Therefore, it is the objective of the present invention to create a plug connector of the aforementioned type which in a simple manner avoids the aforementioned disadvantages and makes possible the locking insertion of not only thicker and therefore relatively stiff cables but also of such thin cables, for example those that are braided, which due to their relatively small cross-section easily buckle when stress is applied in the sliding longitudinal direction.

Only minimal retention forces are necessary to retain "thin cables" in the preliminary locking position. In the case of "thicker cables," this retaining force is too small. The cables would slip out, and so they have to be placed in the end position.

SUMMARY OF THE INVENTION

As a result of the measures according to the present invention, the detent for the plug connector has a first stage, a preliminary locking position, in which cables that buckle easily can be inserted without difficulty because they can overcome the relatively small deflection resistance of the detent without buckling. In the case of cables of this type, the detent is subsequently placed in its final locking position as the second stage. In the case of cables that are relatively stiff, either due to their cross-section or due to the fact that the core is made of solid material, the detent can be immediately placed in its final locking position, in which it can be deflected by such a relatively stiff cable to lock the contact. A further advantage of the aforementioned measures according to the present invention lies in the fact that although the cables, and the male or female plug contacts, are held in the final locking position and therefore can no longer be pulled out, nevertheless they may be pulled out of the housing without difficulty undamaged after a backward motion of the detent from its final locking position into its preliminary locking position by the overcoming of a certain locking resistance. The contacts therefore can be both installed and removed without tools.

According to one preferred embodiment of the present invention, a simple manipulation of the detent is sufficient to move it into its two locking positions.

The detent in a simple manipulation can be brought from its final locking position back into its preliminary locking position.

An individual detent notch or both detent notches can accomplish their function with respect to the locking reception of the detent collar of the male or female plug contact.

The preliminary locking position of the rear detent notch is retained in limited fashion and in the withdrawal direction of the detent, i.e., in the opposite direction, from the final locking step to the preliminary locking step, the front detent notch prevents an unintended complete removal of the slider from the insulating body.

In another embodiment, when a male or female plug contact is inserted into the insulating body the detent in its final locking position between the two guide bars can be deflected in spring-like fashion over the central area of the detent plate.

Both the insertion of male or female plug contacts as well as the removal in the preliminary locking position are simplified with respect to the force that is necessary to be applied.

Advantageous embodiments with respect to the arrangement of multiple rows and/or columns of male or female plug contacts, or with respect to a modular construction of the plug connector, emerge from the features of the invention.

The novel features of the invention are set forth with particularity in the appended claims. The invention will be best understood from the following description when read in conjunction with the accompanying drawings.

DESCRIPTION OF THE INVENTION

Figure 1:
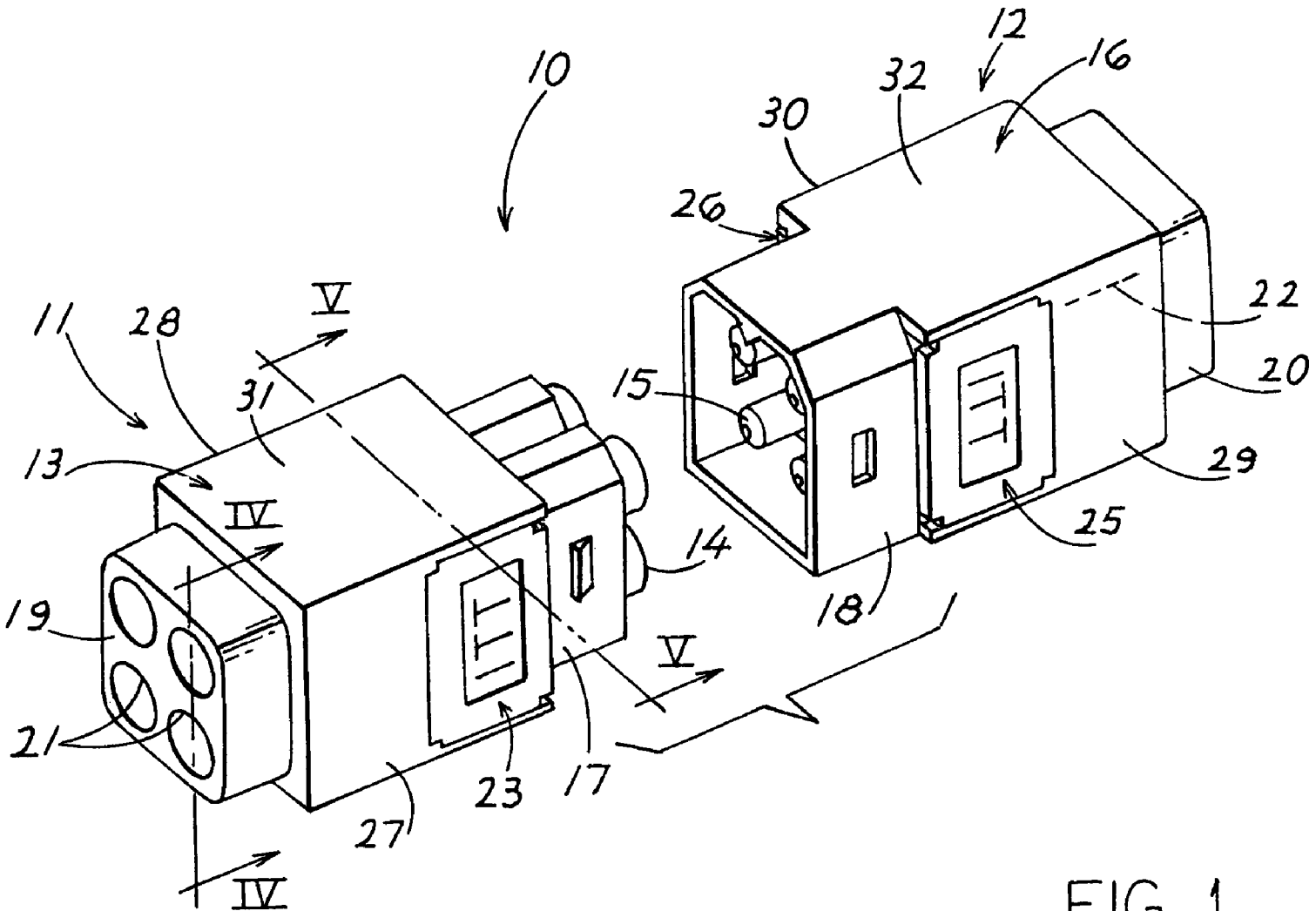
FIG. 1 is an exploded isometric view of a plug connector device made up of a first plug connector having female plug contacts situated above and next to each other and a second plug connector having male plug contacts situated above and next to each other, in accordance with a preferred exemplary embodiment of the present invention.

Plug connector device 10, depicted in the drawing in accordance with a preferred embodiment of the present invention, is made up of a plug connector 11 having female plug contacts 14 and a mating plug connector 12 having male plug contacts 15. Both in the case of plug connector 11 as well as in the case of mating plug connector 12, four female plug contacts 14 and male plug contacts 15, arranged in pairs so as to lie next to each other, i.e. forming a square, are arranged in one insulating body 13 or 16, which constitutes a housing.

Insulating bodies 13 and 16 are configured so that they each with their front end 17 or 18 (female or male attachment) can plug into the other in locking fashion. During such plugging, the front ends of female plug contacts 14 and male plug contacts 15 are simultaneously inserted into each other. The female plug contacts 14 and male plug contacts 15 are each connected in crimped fashion to a cable (not shown) and are inserted into boreholes 21 and 22 in rear ends 19 and 20 of plug connector 11 and mating plug connector 12. The contacts are retained in their respective insulating body 13 and 16 by a detent 23 and 24 or 25 and 26. Both plug connector 11 as well as mating plug connector 12 have identical detents 23 to 26. The detents lie on opposite sidewalls 27 and 28 or 29 and 30 of main part 31 and 32 of insulating body 13 and 16, situated between front end 17 and 18 and rear end 19 and 20. Thus it is sufficient in what follows for further depiction of the invention if only plug connector 11 is described with its detents 23 and 24.

Figure 3A:
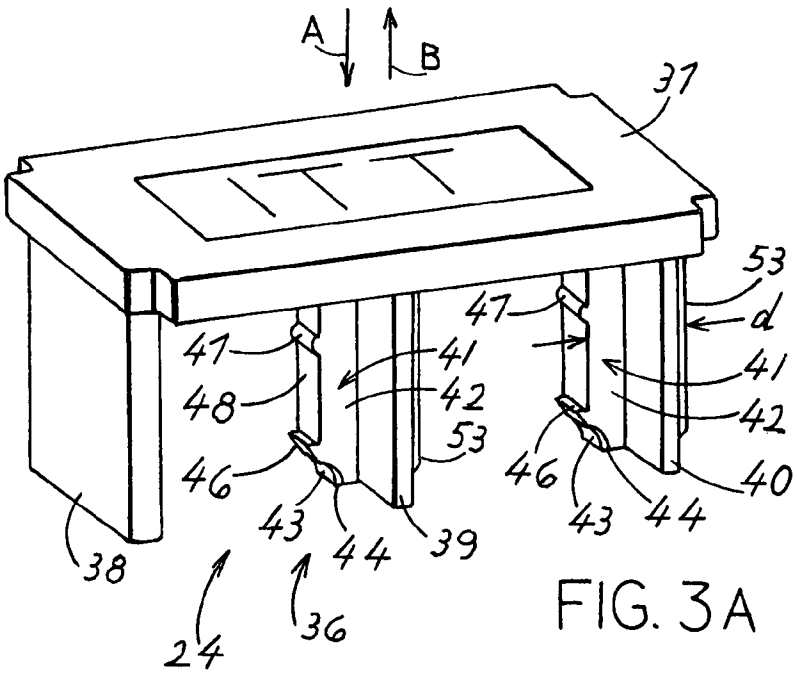
FIGS. 3A and 3B are enlarged isometric views of the detent of the plug connector device of FIG. 1, which can be slid into the insulating body, in a standing or lying arrangement.
Figure 3B:
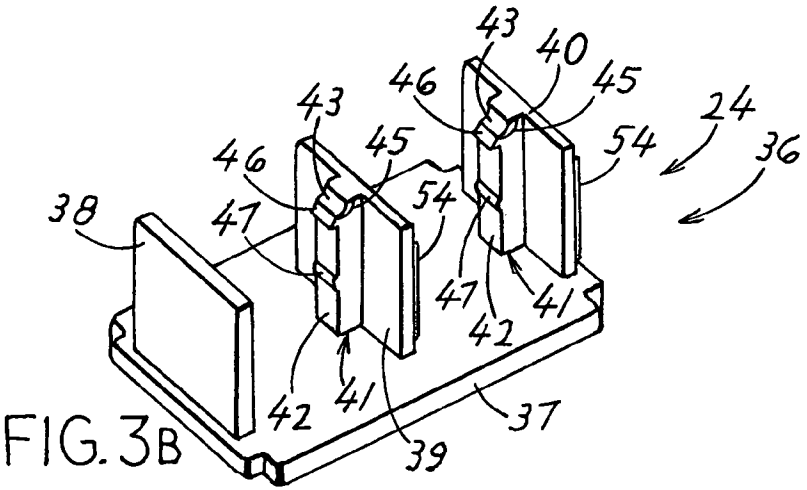

Detent 24, depicted in detail in partial FIGS. 3A and 3B, has the shape of a detent slider 36, which has an activation plate 37. A guide plate 38 and two detent plate 39 and 40 are provided on the activation plate 37. Each detent plate has detent elements 41. Guide plate 38 and detent plates 39 and 40 are each of equal length, whereby detent plates 39 and 40 as well as their detent elements 41 are identical. Guide plate 38 and exterior detent plate 40 lie at the side edges of activation plate 37, which is essentially rectangular, whereas detent plate 39 is arranged roughly in the center. Guide plate 38 and detent plates 39, 40 are also configured so as to be rectangular, whereby the longitudinal side runs in direction A and B of the sliding motion. Detent elements 41 of detent plate 39 and 40 are arranged on the lateral surface that is facing guide plate 38 and central detent plate 39.

Detent elements 41, which are identical in detent plates 39, 40, each has a detent bar 42, which runs in the longitudinal direction of detent plates 39, 40 and is arranged roughly laterally in the center. The length of detent bar 42 roughly corresponds to the length of detent plate 39 and 40. At the front end, in the direction of motion A or B, detent bar 42 has a guide bevel 43, which acts in direction of motion A and B, and on both sides a chamfer 44 and 45. Detent element 41 also has a front detent projection 46 in direction of motion A and B and a rear detent projection 47, which are arranged at a specific distance from each other. Front detent projection 46 is configured so as to be roughly wedge shaped, whereby the wedge surface is situated forward in the direction of motion, whereas rear detent projection 47 is configured so as to be roughly semicylindrical. Detent projections 46 and 47 protrude diagonally with respect to direction of motion A and B beyond guide surface 48 of detent bar 42. Detent elements 41 together constitute one integral piece along with detent plates 39 and 40, whereby detent slider 36 in its totality is configured in one piece and is made of plastic.

Figure 2:
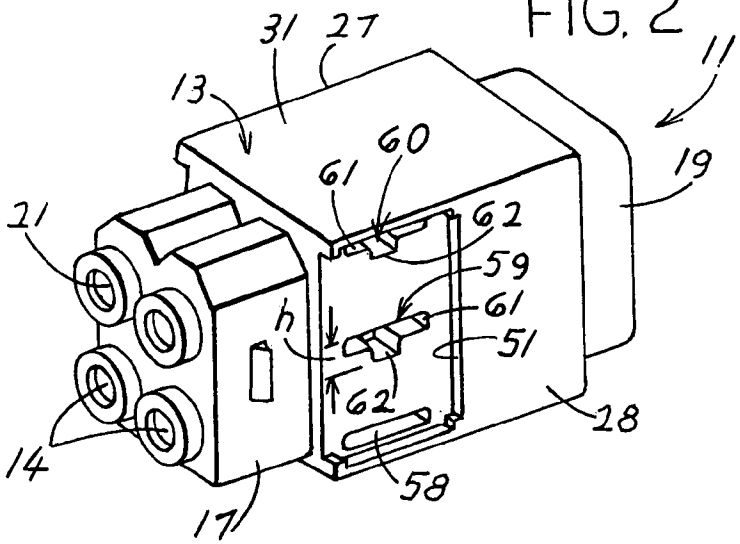
FIG. 2 is an isometric view of the insulating body of the first plug connector without detent and in a position that is rotated by 180° from FIG. 1.

FIG. 2 depicts in greater detail the configuration of insulating body 13 and its main part 31 (which is identical to main part 32 of insulating body 16). The body main part 31 receives detent slider 36 of detent 24. For this purpose, main part 31 of insulating body 13 is provided with a guide slot 58 for guide plate 38 and with detent slots 59, 62 for detent plates 39 and 40, including detent bars 42. All slots 58 to 60 protrude through the wall of main part 31 transverse with respect to the longitudinal extension of boreholes 21 and, according to FIG. 5, over the entire diameter of boreholes 21. In this context, detent slots 59 and 60 each partially intersect assigned boreholes 21, whereas guide slot 58 (FIG. 2) runs past borehole 21. Slots 58 and 60 begin at the base of a recess 51 that is provided in relevant sidewall 28, in which activation plate 37 is accommodated in its final locking position. Recess 51 (FIG. 2) is open at front end 17 of insulating body 13, so that activation plate 37 can be grasped and moved in accordance with arrows A and B.

Detent plates 39 and 40 each have on their side surface facing away from detent elements 41 two parallel longitudinal bars 53 and 54 (FIG. 4), which essentially run over the entire length of detent plates 39, 40 and which are arranged in the vicinity of the transverse edges of detent plates 39, 40.

Figure 4:
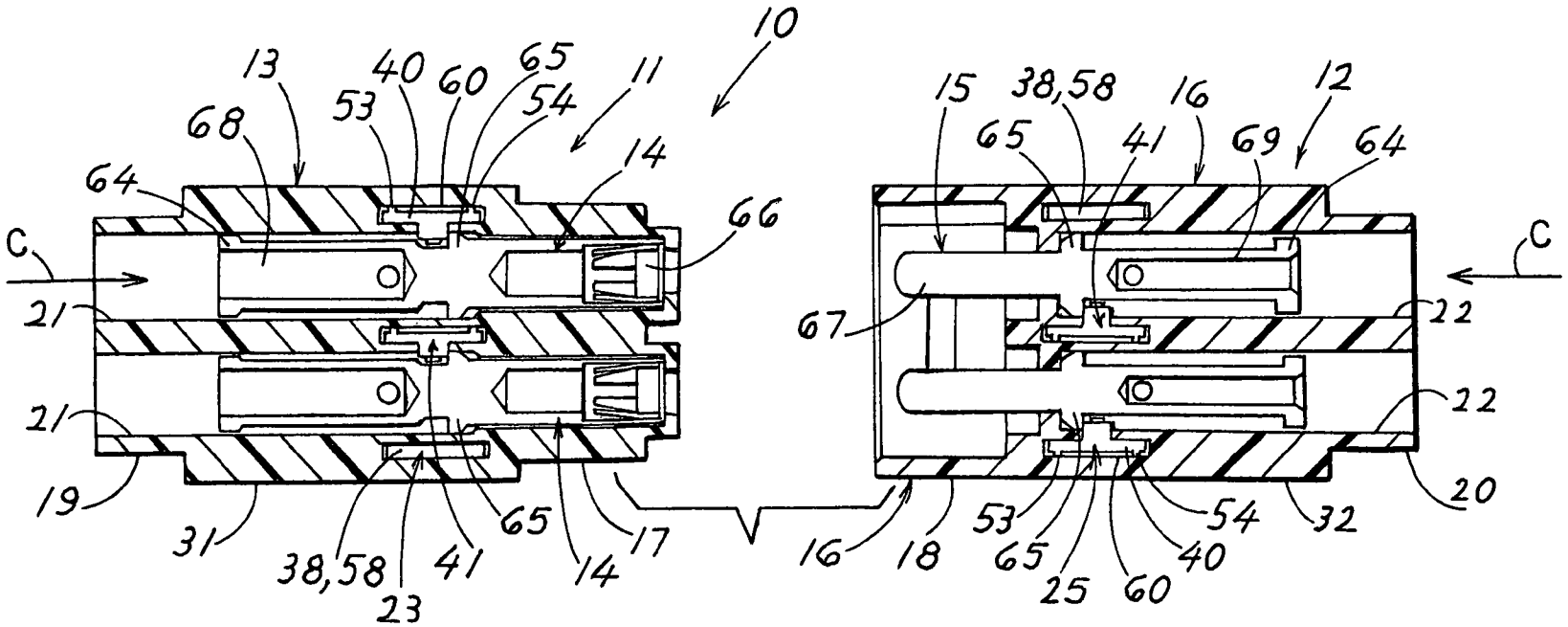
FIG. 4 depicts a sectional view taken on line IV-IV of FIG. 1.

Identically configured detent slots 59 and 60 (FIG. 2) are made up of a longitudinally running elongated rectangular slot part 61 and a transverse slot part 62, perpendicular thereto in the longitudinal center. The length of longitudinal slot part 61 corresponds to the width of detent plate 39, 40, whereas the width of longitudinal slot part 61 is equal to the thickness of detent plate 39, 40, including longitudinal bars 53, 54, as can be seen in FIG. 4. The width of transverse slot part 62 (FIG. 2) corresponds to the width of detent bar 42 of detent elements 41, which also applies to the depth of transverse slot part 62 in relation to the thickness of detent bar 42. In other words, clearance h of longitudinal slot part 61 and transverse slot part 62, added together, is equal to thickness d (FIG. 3A) of detent plate 39, 40 plus that of longitudinal bars 53, 54 and of detent bar 42, in other words without the protruding amount of detent projections 46, 47.

Figure 5:
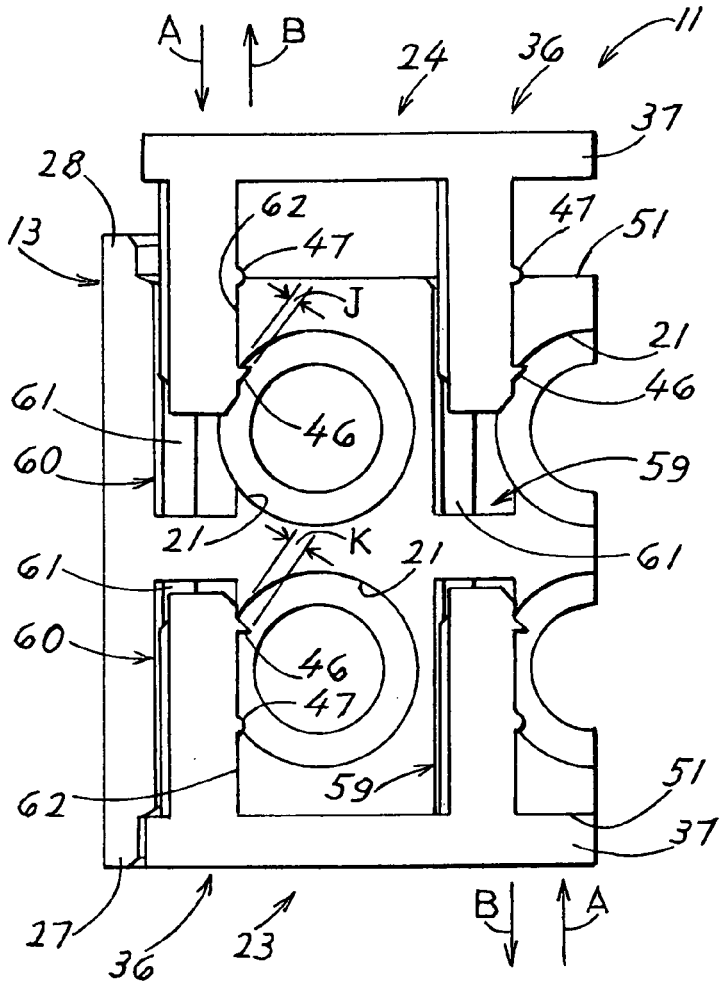
FIG. 5 depicts a cutaway view along the line V-V of FIG. 1, but in the preliminary locking position of one detent and in the final locking position of the other detent.
Figure 6:
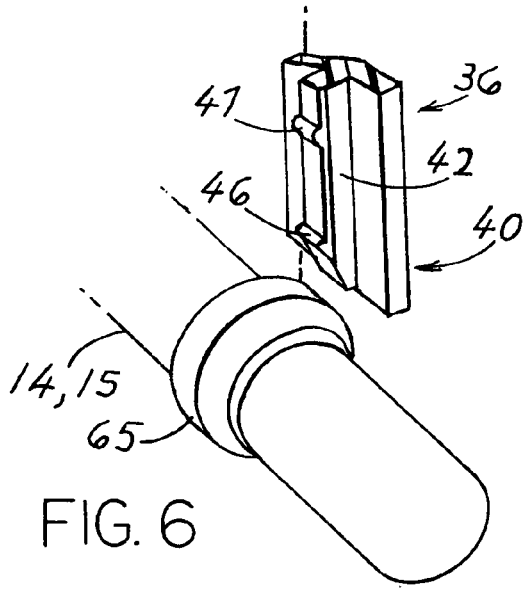
FIG. 6 is a partial isometric view showing a detent bar of FIG. 3A approaching the area behind the rear of a contact collar.

As can be seen from FIG. 5, longitudinal slot part 61 of detent slots 59, 60 runs past its respective borehole 21, whereas transverse slot part 62 intersects its respective borehole 21. In addition, it is depicted that detent slider 36 of respective detent 24 can occupy a first, or preliminary locking position, which is depicted in FIG. 5 on top, and a final locking position, going further in the direction of motion A and B, which is depicted in FIG. 5 on the bottom. While in the "top" preliminary locking position, activation plate 37 of detent slider 36 is arranged at a distance from relevant sidewall 28. The projection 46 projects a small distance J into the borehole 21. In the "bottom" final locking position, activation plate 37 of detent slider 36 is accommodated in recess 51 of relevant sidewall 27 in a form-locking manner. The projection 47 then projects a further distance K into the borehole 21.

In the preliminary locking position, front detent projection 46 grips the end of transverse slot part 62 that opens into borehole 21 from behind, whereas rear detent projection 47, due to the lesser depth of transverse slot part 62, makes contact at its open edge in recess 51. In this way, due to rear detent projection 47, the result is a defined first locking action in the preliminary locking position. Due to front detent projection 46, an undesirable withdrawal of detent slider 36 from insulating body 13 is prevented in the event that detent slider 36 is brought from the final locking position to the preliminary locking position in direction of motion A or B.

In the final locking position, as defined by the contact of activation plate 37 within recess 51, rear detent projection 47 grips the edge of transverse slot part 62, that opens into borehole 21, from behind.

As can be seen from FIG. 4, both female plug contacts 14 as well as male plug contacts 15, have front end 66, 67 which facilitate insertion connection into the respective other end 67, 66. Their rear crimping end 68, 69 are for the crimping attachment of a cable, and have a larger-diameter detent collar 65. The collar exterior diameters essentially correspond to the interior diameter of boreholes 21, 22. The same applies to a rear collar 64 at crimping end 68, 69, which exclusively performs guide tasks during the insertion of female plug contacts or male plug contacts. Front detent collar 65, assisted by a cable connected thereto, facilitates the locking retention of contacts 14, 15 within insulating body 13, 16 with the assistance of detents 23, 24 or 25, 26. As can be seen, detent collar 65 (FIG. 4) of contacts 14, 15 is in a locking position in insertion direction C behind the cutaway line of boreholes 21, 24 and transverse slot part 62, i.e., behind respective detent elements 41 (FIG. 3B) (detent bar 42 and detent projections 46, 47) which engage in boreholes 21, 22.

If detent slider 36 is in its preliminary locking position, as seen in the upper part of FIG. 5, and if then a female plug contact 14 (FIG. 4) is inserted by being pushed onto a cable, connected thereto, in the direction of arrow C, then detent collar 65 in opposition to the detent effect of front detent projection 46 (FIG. 5), which is deflected, is brought behind front detent projection 46 in locking fashion, whereby at another location within insulating body 13 a limit stop is provided for female plug contact 14. This deflecting of front detent projection 46 during the insertion motion in the direction of arrow-C of a female plug contact 14 via or by means of a cable is associated with relatively small deflection resistance, which could also be overcome in the other direction for purposes of removal. An unintended withdrawal of female plug contact 14, however, is prevented. In addition, the deflection resistance in direction of insertion motion C is so small that, in the case of a female plug contact 14 or male plug contact 15, which is connected to a very thin cable and therefore one possessing minimal breaking resistance, for example a braided cable, the grasping of the cable during insertion does not lead to buckling.

After this preliminary locking position, detent slider 36 is brought into its final locking position in the direction of arrow A and B, in which detent bar 46 and both detent projection 46, 47 grasp detent collar 65 from behind, as can be seen from the lower part of FIG. 5, so that a withdrawal of contact 14, 15 by the cable is not possible without destruction.

If a cable that has greater buckling resistance is inserted into insulating body 13, 14, for example, one that is thicker or has a solid-wire cross-section, then detent slider 36 can be in the final locking position immediately. By deflecting detent bar 42 and by bending detent plate 39, 40 between longitudinal bars 53, 54, it is achieved that detent collar 65 can arrive behind detent bar 42 and detent projections 46, 47 of relevant detent sliders 36. This relatively greater deflection force can be overcome without difficulty during the insertion process by using a cable that has greater buckling resistance, without the cable buckling. In this final locking position, the cable cannot be withdrawn without destroying it, as was mentioned. In the event that a contact 14, of this type is able to be withdrawn, detent slider 36 is returned from its final locking position to its preliminary locking position.

Usually, depending on the thickness at rear crimping end 68, 69 of the cable being used, or attached, female plug contacts 14 and male plug contacts 15 are used that have varying interior diameters for receiving the insulated conductor of the cable and that have various exterior diameters, beyond which crimping results. However, the -arrangement and the exterior diameter of detent collar 65 as well as of rear guide collar 64 remains the same. Therefore, in every case, between the exterior diameter of rear crimping end 68, 69 and the exterior diameter of detent collar 65 there remains a sufficient annular surface behind which detent bar 46 and detent notches 46, 47 of detent slider 36 engage.

From the exemplary embodiment depicted, it can be seen that in each case a detent slider 36 is assigned to two adjoining boreholes 21, 22 and contacts 14, 15, so that in a plug connector 11, 12 having four contacts 14, 15 that are arranged along a square, two locking sliders 36 are used that can be attached to opposite sidewalls 27, 28.

According to one un-depicted exemplary embodiment of the present invention, by way of example, four, six, or more contacts 14, 15 are arranged in a row, so that one detent slider 36 is assigned to each pair of two adjacent contacts 14 or 15. The same applies if the multiple pairs of contacts 14, 15 run in two rows, one over the other.

It is also possible that a detent slider, instead of two adjacent contacts 14, 15, grasps three or more adjacent contacts, whereby detent slider 36 is expanded to more than two detent plates that have detent elements.

It is also possible in such plug connector devices 10 to construct individual plug connectors 11, 12 as modules and to detachably connect them to each other next to each other and/or over each other.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector which has an insulating body with at least one borehole (21) that is elongated along a first direction and with at least one slot (61, 62) extending in a second direction that is perpendicular to said first direction and that intersects said borehole, comprising: a contact that lies in said borehole; a detent slider (36) that is slidable in said slot, said detent slider having first and second projections (46, 47), said detent slider being slideable into said slot to a first position wherein only a first of said projections (46) projects into said borehole, and said detent slider being slidable further into said slot to a fully installed position wherein both of said projections (46, 47) project into said borehole;

wherein said detent slider includes an activation plate (37) with opposite plate surfaces, and at least one detent plate (39) that projects perpendicular to a first of said plate surfaces from said first plate surface; said detent plate (39) has first and second opposite plate surfaces, and said detent slider has a detent bar (42) that lies against one side of said detent plate [opposite plate surfaces] along the entire length of the detent bar, with said projections projecting from said bar in a direction away from said detent plate and an opposite side of said detent plate having a longitudinal bar aligned along with said detent bar.

2. The connector described in claim 1, wherein:

said slot has an outer end and said body has an end surface (51) at the outer end of said slot, with one of said projections (47) abutting said end surface (51) to hold the position of said detent slider when said detent slider lies in said first position.

3. The connector described in claim 1, wherein:

in said first position of said detent slider one of said projections projects a distance J into said borehole, and in said fully installed position of said detent slider said one of said projections projects by a distance K into said borehole, wherein said distance K is greater than said distance J.

4. The connector described in claim 1 wherein:

said body has a flat side (28) with a recess (51) in said flat side, and said slot (61, 62) extends into said recess;

said recess extending to an end of said flat side (28) so a person can engage said edge of the activation plate to more easily move out said detent slider from said slot.

* * * * *